US005131573A

United States Patent [19]

Tommaney et al.

[11] Patent Number: 5,131,573

[45] Date of Patent: Jul. 21, 1992

[54] METHOD AND DEVICE FOR SHROUDING A STREAM OF MOLTEN METAL

[75] Inventors: Joseph W. Tommaney, Lockport; Gordon J. Martin, Newfane; Gary R. Bowerman, Lockport; Reginald C. Buri, Gasport, all of N.Y.

[73] Assignee: Allegheny Ludlum Corporation, Pittsburgh, Pa.

[21] Appl. No.: 673,704

[22] Filed: Mar. 22, 1991

[51] Int. Cl.[5] ..... B22D 41/58

[52] U.S. Cl. ..... 222/603; 222/590; 266/236

[58] Field of Search ..... 222/603, 590, 607; 266/216, 217, 236

[56] References Cited

U.S. PATENT DOCUMENTS

| | | | |
|---|---|---|---|
| 3,482,621 | 12/1969 | Halliday | 222/603 |
| 4,530,393 | 7/1985 | Rokop et al. | 222/603 |
| 4,589,465 | 5/1986 | Gerding | 164/66.1 |
| 4,840,297 | 6/1989 | Weekley et al. | 222/607 |

OTHER PUBLICATIONS

"The Shrouding of Top Poured Ingots", Petruska, *I&SM*, Aug. 1991.

Hashio, M. et al, "Improvement of Cleanliness in Continuously Cast Slabs at Kashima Steel Works", *2nd Process Technology Conference on Continuous Casting of Steel*, (Chicago, Ill., ISS-AIME, 1981, pp. 180-187.

Vonesh et al, "Inert Gas Shrouding of Molten Metal Streams", 1986 AISE Spring Conference, Philadelphia, Pa., 21-23 Apr. 1986.

*Primary Examiner*—Scott Kastler

*Attorney, Agent, or Firm*—Patrick J. Viccaro

[57] ABSTRACT

A method and device are described for preventing the atmospheric contamination of molten metal during the transfer thereof from one vessel to another. The device includes a first metal ring releasably connected to a molten metal receiving vessel and second metal ring connected to a vessel containing the molten metal to be transferred. A viewing port is provided to allow observation of the molten metal as it is being transferred. A ceramic fiber blanket which encloses the molten metal stream as it is being transferred interconnects the two rings. During operation, an opening of the molten metal containing vessel attached to the second ring and the ceramic fiber blanket are aligned concentrically above the opening of the receiving vessel and the first ring. In the preferred embodiment, the ceramic fiber blanket is then mated to the first metal ring to form an enclosure around the path defined between the molten metal containing vessel and the receiving vessel for the transfer of molten metal therebetween. An inert gas is injected into the enclosure to purge it of atmospheric contaminants and molten metal may be transferred between the vessels.

29 Claims, 3 Drawing Sheets

METHOD AND DEVICE FOR SHROUDING A STREAM OF MOLTEN METAL

BACKGROUND OF THE INVENTION

1. Field of the Invention

This invention relates generally to methods and devices for transferring molten metal from one vessel to another, and more particularly, to a method and device for shrouding the flow of molten metal from atmospheric gases during the transfer thereof from one vessel to another.

2. Description of the Invention Background

In processes for making steel and other alloys, metals are typically heated to a molten state and transferred from one vessel to another. In particular, the molten metal is often transferred or poured from a ladle into ingot molds or other vessels. The operation of transferring the molten metal is called teeming and the stream of molten metal is referred to as a teem stream.

The ladle, a large refractory-lined vessel which is used to receive and contain molten metal when it is removed from a furnace, serves to transport the molten metal to other locations in a steel or alloy making facility. The molten metal is transferred into other vessels whose character depend on the next processing step for the molten metal. It should be appreciated that ladles take different forms and shapes, and that the molten metal may be transferred out of the ladle by different methods. One common method for transferring the molten metal out of a ladle is called the bottom pour technique. In the bottom pour technique, the ladle includes a hole located on the bottom of the ladle which is sealed with a plug. The plug can then be removed by an actuator to permit the molten metal to flow from the ladle by gravity.

Usually, the molten metal is transferred from the ladle to some form of mold where the molten metal is allowed to cool and solidify. Typically, the molten metal is not transferred directly into the mold; instead it is transferred through a conduit into the mold. Often, the molten metal is poured into a funnel shaped, vertical tube or trumpet stand from which the molten metal is channeled into one or more molds.

A problem encountered in prior practice arose during the transfer of molten metal from the ladle to another vessel. Various gases from the ambient atmosphere in which the transfer occurs can be entrained in the molten stream. In particular, the molten metal may become contaminated with moisture or with gases such as oxygen, hydrogen or nitrogen. Contamination of the molten metal may lead to the reoxidation of the molten metal. The chemistry of the molten metal is carefully controlled to achieve specific properties in the alloy formed from the molten metal. Reoxidation products in the finished alloy formed due to exposure to oxygen, hydrogen, nitrogen or moisture can detrimentally effect the machinability, surface quality and other mechanical properties of the alloy.

Various methods or devices designed to prevent the contamination of molten metal streams by atmospheric gases during teeming operations have been developed. In one such method, a shroud of inert gas surrounds a molten metal stream to avoid contamination of the molten metal stream by atmospheric gases during teeming operations.

In particular, U.S. Pat. No. 4,840,297 issued to Weekley et al. describes a device for shrouding a stream of molten metal with an inert gas as it is being transferred from one vessel to another. The Weekley et al. reference describes the use of a shroud made from monolithic ceramic fiber in combination with a metal ware to maintain a shroud seal between a pouring ladle and a receptacle for molten metal. The shroud described in Weekley et al. appears to be a formed, rigid device. A metal ware assembly is used in conjunction with the ceramic fiber shroud to interconnect the ladle and receptacle vessel. The combination of the shroud and ware assembly provides a positive seal between the ladle and receptacle vessel. The shroud/ware assembly combination is then purged with an inert gas by way of a gas manifold which is positioned within the ware assembly. Devices which rely on rigid shrouding enclosures frequently require permanent and expensive mechanical modifications to both the ladle or receptacle vessel. Expensive, cumbersome support devices are often required to prevent the transfer of the weight of the metal laden ladle to the trumpet stand when the two are interconnected by a rigid shroud. Such support devices and mechanical modifications represent a significant cost and may preclude the use of the device in existing facilities. Furthermore, because these devices are made from rigid materials, they are not adjustable to accommodate a variation in distance between the ladle and the receptacle.

Another method known to be used for shrouding the transfer of molten metal from a ladle to a receptacle vessel involves the use of an asbestos curtain loosely draped over the opening of the receptacle vessel to provide a physical enclosure for a flow of inert gas around the molten metal stream. Hashio, M. et al., "Improvement of Cleanliness in Continuously Cast Slabs at Kashima Steel Works, "*2nd Process Technology Conference on Continuous Casting of Steel* (Chicago, Ill.) ISS-AIME, 1981, pp. 180-187. Curtain enclosures do not maintain a positive seal between the shroud and the receptacle vessel.

Other methods and devices have also been used to provide atmospheric shrouds around transfer streams of molten metal. For example, a reference by Vonesh et al., entitled "Inert Gas Shrouding of Molten Metal Streams" presented at the 1986 AISE Spring Conference in Philadelphia, Pennsylvania, describes a method and apparatus which provides a carefully controlled flow of inert gases around a molten metal stream without a physical enclosure to contain the inert gases. Methods and devices such as described in the Vonesh et al. reference which do not include a physical enclosure suffer from the drawback that they require large amounts of the inert gas to provide the shrouding effect.

Consequently, a need exists for a shrouding method and device which will effectively shroud a molten metal stream as it is transferred from a ladle to a receptacle, without the need for significant mechanical modifications to either the ladle or receptacle. There is also a need for a shrouding method and device which can be used over a range of distances between the ladle and receptacle. Finally, there is a need for a shrouding method which minimizes the amount of inert gas used.

SUMMARY OF THE INVENTION

The present invention provides a shrouding device which is useful for preventing atmospheric contamination of molten metal streams during the transfer thereof from one vessel to another vessel. In particular, the present invention overcomes the disadvantages of prior shrouding devices which require significant mechanical modification to the metal transfer vessels. Further, the present invention overcomes disadvantages associated with prior shrouding devices which provided mechanically rigid enclosures between the ladle and molten metal receiving vessel. In a preferred embodiment of the method of the present invention, the flow of inert gas through the shrouding device is recycled, thereby reducing the amount of gas used. Recycling the gas overcomes the disadvantages of those prior art methods for shrouding molten metal transfer streams which suffer from a high consumption of inert gas.

The present invention provides a device for shrouding a flow of fluid during the transfer thereof between a pair of vertically spaced vessels. The device includes an enclosure having generally vertically opposed apertures for providing fluid communication between the pair of vessels and means structured for adjoining each of the apertures in operatively fluid tight communication with the pair of vessels. The device also includes means for adjusting the spacing between the vertically opposed apertures and means for flowing a desired gas through the enclosure. The desired gas is preferably an inert gas, such as argon.

The device may also include means for measuring the oxygen or nitrogen content inside the enclosure, means for measuring the pressure within the enclosure or other sampling and measuring devices.

The method of using the device to shroud the transfer of fluids from a first vessel to a second vessel includes the steps of attaching one end of a flexible, open-ended enclosure to the exit port of the first vessel so that the first aperture of the device is centered relative to the exit port of the first vessel, attaching one end of an open-ended enclosure to a metal receiving port in the second vessel so that the second enclosure is centered relative to the metal receiving port, mating the open ends of the first and second enclosures and introducing a flow of a desired gas through at least one of the first or second enclosures to eliminate atmospheric contaminants in the enclosure. The step of removing atmospheric contaminants is preferably achieved by flowing a desired gas, such as argon or another inert gas, through the enclosure. The transfer of molten metal from the first to the second vessel is then initiated. The method preferably further includes the step of monitoring the oxygen content inside the enclosure during the molten metal transfer operation.

BRIEF DESCRIPTION OF THE DRAWINGS

The present invention can be better understood by reference to the drawings in which.

DETAILED DESCRIPTION OF THE PREFERRED EMBODIMENTS

Figure 1:
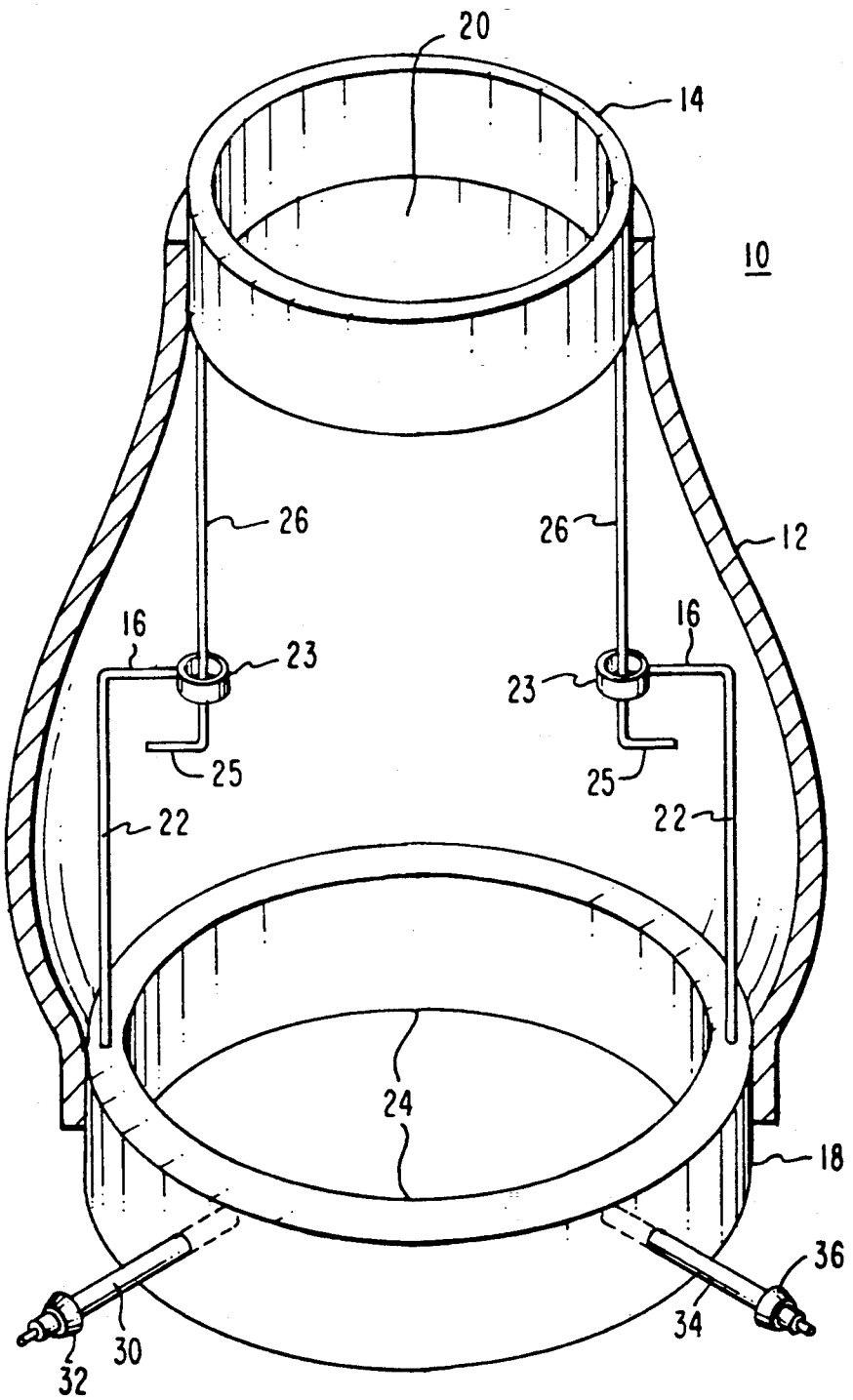
FIG. 1 is a section view of one embodiment of the device of the present invention.

Generally, a shrouding device 10 shown in FIG. 1 includes a flexible, gas impervious enclosure 12 having two connection members, or rings 14, 18 at each end of the enclosure 12 which define apertures 20, 24 through which fluids, such as molten metal can flow. One or both rings 14, 18 include gas manifold ports 30 through which an inert gas may be injected into the enclosure 12, and other ports 34 through which the inert gas may be removed. The top ring 14 of the enclosure is centered under the exit port of the ladle so that the molten metal discharged from the exit port will flow through the center of the ring.

The term "ring", as used herein, is not limited to annular or circular structures. Other configurations may be used. The configuration of any particular ring is determined by the design of the particular ladle and port with which it is intended to be used. The ladle ring design should provide a satisfactory and substantially fluid tight seal when mated to the ladle. While there may be some degree of space between the ladle and the ring, it will be insubstantial in terms of admitting contaminants to the flowing molten metal. Those skilled in the art will recognize that a variety of ring designs can be made to effect the desired sealing function.

The second connection member, or ring 18 of the shrouding device 10 is designed to be mated with a molten metal receiving vessel into which the molten metal will be poured. Typically, this receptacle vessel will be a trumpet stand for directing the flow of molten metal into one or more ingot molds. While the ladle ring 14 is attached to the ladle in a relatively permanent fashion, the second ring 18 of the shrouding device 10 should be releasably attached for easy and relatively quick attachment and removal during repeated teeming operations. Consequently, the ladle ring 14 and the rest of the shrouding device 10 will typically be attached to the ladle during multiple teeming operations while the second ring 18 will be attached and removed from particular molten metal receiving vessels before and after each teeming operation.

Referring now to FIG. 1, a shrouding device 10 is illustrated which includes a flexible enclosure 12, a ladle ring 14, and a second ring 18. The enclosure 12 is made from a heat resistant flexible material. For example, commercially available asbestos or ceramic fiber materials could be used for this purpose. Ceramic fiber materials are preferred over asbestos due to the known hazards of asbestos use. Typically, the ladle ring 14 will be made from a metal alloy. The flexible enclosure material is attached around the outer circumference of the ladle ring 14 in a manner sufficient to provide a gas impervious seal. Likewise, the second ring 18 is typically made from a metal alloy and has attached to its outer circumference, the lower edge of the flexible enclosure material 12 in a manner sufficient to provide a gas impervious seal. Either ring 14, 18 could be made from materials other than metal so long as the material had sufficient heat resistance and structural integrity to withstand repeated exposure to molten metal and repeated attachment and detachment from the ladle and particularly receiving vessels during multiple teeming operations.

The apertures 20, 24 in ladle ring 14 and second ring 18 should be centered axially relative to each other. This insures that a molten metal stream poured through the center of the ladle ring 14 will pass through the center of the second ring 18. In addition, the second ring 18 must be centered over the mouth of the molten metal receiving vessel. Guiding members 22 and 26 assist in maintaining the proper axial positioning of the apertures in the ladle ring 14 and second ring 18 relative to each other. In particular, member 22 consists of an elongate rod vertically attached to the second ring 18 on the inside of the enclosure 12. Member 22 includes at its top end 16 (i.e., the distal end from ring 18) a right angle bend with an end ring 23 at the end of the right angle bend. Member 26 is shaped identically to member 22 but it is suspended vertically from the bottom of ladle ring 14 and extends downward. A right angle bend at its end provides a stop 25.

As can be seen from FIG. 1, the end rings 23 encircle the rod portions of members 26. In this manner, the distance between ladle ring 14 and second ring 18 can be varied as a result of the vertical sliding of members 22 and 26 while maintaining the axially centered position of rings 14 and 18. In addition, the flexibility of the enclosure 12 allows the distance between the ladle ring 14 and second ring 18 to be varied without breaching the gas impervious seal of the enclosure. It should be appreciated that the vertical sliding relationship between members 22 and 26 insures that no weight is transferred from the ladle ring 14 to the second ring 18. Likewise, the flexible enclosure 12 is incapable of transferring weight from the ladle ring 14 to the second ring 18 due to a lack of mechanical rigidity in the flexible enclosure. Typically, two or more pairs of corresponding members 22 and 26 would be used and each pair of members 22 and 26 is preferably spaced equidistantly from the other members around the circumference of the rings 14, 18.

The second ring 18 further includes gas manifold ports 30 and 34 for injecting and removing, respectively, an inert gas, such as argon, from the interior space of the enclosure. The ports 30 and 34 include holes drilled through the second ring 18 to the interior circumference of the ring and connections 32, 36 at the outer circumference of the ring for attaching an external supply (not shown) of the inert gas and an appropriate manifolding system (not shown) for removing the inert gas. Any suitable manifold system including means, such as a pump, for withdrawing and preferably circulating the gas may be used. It should be appreciated that multiple ports could be used for either injecting or removing the gas and that such ports may also be included in the ladle ring.

The preferred embodiment of the shrouding device of the present invention is illustrated in FIGS. 2-5. Referring to FIGS. 2-5, the shrouding device 62 includes a first connection member in the form of a metallic ladle ring 48, a flexible enclosure 64, and a second connection member in the form of a ring 68 all of which are used to interconnect a ladle 40 and a molten metal receiving vessel 44.

Figure 3:
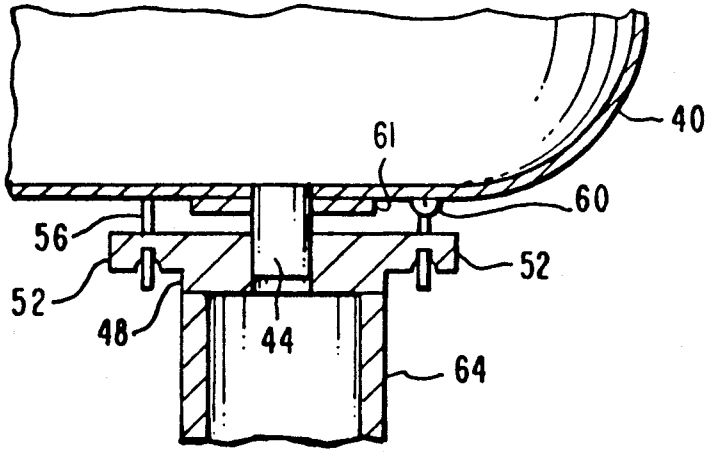
FIG. 3 is a cross-sectional view of the attachment of the top portion of the shrouding device of FIG. 2 to the molten metal containing vessel.

Referring to FIG. 3, the ladle 40 includes a fixed retainer loop 56 and a hinged retainer loop 60. Loop 56 is fixed in place by welding to the ladle bottom. The hinged retainer loop may be moved through a variety of positions. The ladle ring 48 includes two support ring ears 52 which are designed to fit into the fixed retainer loop 56 and the hinged retainer loop 60. The end of one support ear 52 is inserted in fixed loop 56 as flexible ring seal 61 is compressed against ladle bottom. Hinged loop 60 is swung over the end of the other support ear 52 and positioned in detent area. The entire ring 48 and support ear 52 assembly is thereby retained against ladle bottom by loops 56 and 60 while maintaining a seal between the ladle bottom and the ladle ring 48. In this manner, the ladle ring 48 can be suspended from the ladle 40 for an extended period of time (i.e., during multiple teeming operations) but be removed with relative ease when necessary by changing the position of the hinged retainer loop 60. The weight of the ladle ring 48 is borne by the ladle 40. The fixed and hinged retainer loops 56, 60 are positioned on the ladle 40 so that the aperture 20 of ladle ring 48 will be axially centered relative to the ladle exit port 44. The aperture 20 may be larger than shown in FIG. 3 to accommodate different sized ladle exit ports.

Attached to the ladle ring 48 is an enclosure 64 which preferably consists of a double layer of ceramic fiber blankets. The ceramic fiber blankets are concentrically attached to the ladle ring 48 in a manner which provides a gas impervious seal between the ring and the ceramic fiber blanket. It should be appreciated that, for purposes of preventing contact between atmospheric contaminants and the flowing molten metal, the ladle ring 48 when held in position by the fixed and hinged retainer loops 56, 60 provides substantially fluid tight communication between the ladle ring 48 and the ladle 40.

Figure 4:
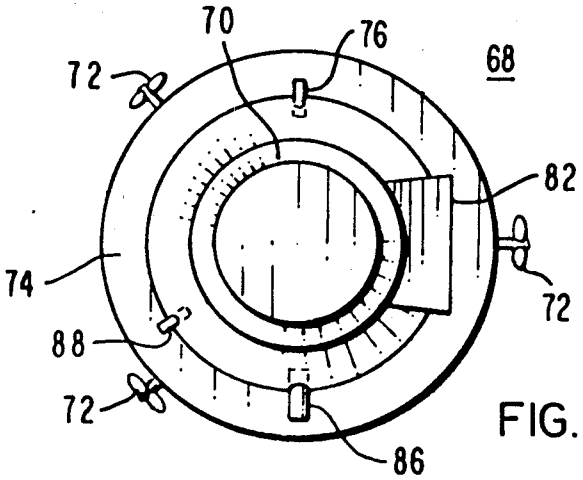
FIG. 4 is a top plan view of the bottom portion of the shrouding device of FIG. 2.
Figure 5:
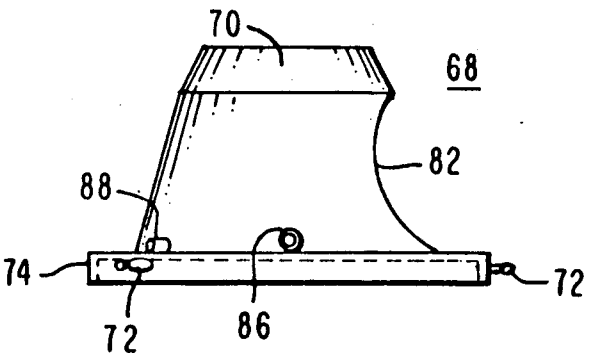
FIG. 5 is a side view of the bottom portion of the shrouding device shown in FIG. 4.

Referring to FIGS. 4 and 5, the second connection member, or trumpet ring, 68 is made from a suitable heat resistant metal. Trumpet ring 68 includes a rigid lower section 74 and a rigid upper section 75. Upper section 75 is generally frusto-conical in shape and includes a tapered end 70. The tapered end 70 is provided to allow the trumpet ring 68 to fit smoothly within the inner diameter of the layers of the ceramic blankets of enclosure 64 and provide a gas impervious seal when they are mated together. It should also be appreciated that the use of a tapered end 70 on the trumpet ring 68 and a flexible enclosure 64 allows a particular trumpet ring to be mated with various sizes of ladle rings and enclosures and permits vertical adjustment of the ladle ring and trumpet ring relative to each other while still providing substantially fluid tight communication between the two. The lower end 74 of the trumpet ring 68 is flanged and fits around the outer circumference of the trumpet stand 44. Further, the trumpet ring 68 includes locking thumbscrews 72 which are used to releasably secure the trumpet ring 68 to the trumpet stand 44. Preferably, three locking thumbscrews are included in the trumpet ring and located equidistant from each other around the circumference of the trumpet ring to provide a secure attachment of the trumpet ring to the trumpet stand.

The trumpet ring 68 includes a transparent portion to serve as a viewing window 82. The viewing window 82 is included to allow observation of the molten metal stream as it is being transferred from the ladle 40 to the trumpet stand 44. Frequently, it is desirable to view the molten metal stream as it is being transferred to determine that it is positioned correctly. Moreover, by viewing the molten metal stream it is sometimes possible to determine if it is being contaminated or if anything about the stream appears to be improper. The trumpet ring 68 further includes an oxygen sampling port 76 which communicates to the enclosed area within the trumpet ring 68. The oxygen sampling port 76 is connected to a commercially available oxygen analyzer 78 (FIG. 2) which is used to monitor the oxygen concentration within the shrouding device 62. The ability to monitor oxygen is particularly helpful to indicate whether or not leakage of atmosphere gases is occurring into the inert gas shrouded area within the shrouding device. It should be appreciated that analyzers for other types of gases could also be used. For example, a nitrogen analyzer could be used to determine the concentration of nitrogen within the shrouding device.

The trumpet ring 68 further includes a gas port 86 through which a desired inert gas, such as argon is injected. Preferably, the gas port 86 is fluidly connected to a gas manifold (not shown) within the trumpet ring 68 which causes the inert gas to be uniformly distributed about the interior circumference of the trumpet ring. Multiple ports 86 for both the injection and removal of the inert gas may be used to provide improved flow of the inert gas into and out of the shrouding device 62. The trumpet ring also includes a pressure sampling port 88 which communicates with the interior of the gas shrouding device 100. Temperature monitors may also be provided.

During operation of the shrouding device 62 a ladle 40 with a ladle ring 48 and ceramic blanket enclosure 64 attached is positioned in axial alignment over the opening of a trumpet stand 44 which already has the trumpet ring 68 attached. The ladle 40 is then positioned so that the ceramic blanket enclosure 64 can be mated against the tapered end 70 of the trumpet ring 68. The size and weight of the blanket enclosure cause it to lie, touching the surface of the tapered end 70 or upper section 75 so that there is substantially fluid tight communication between the two components. Inert gas may be injected into the enclosure and withdrawn in a flow-through pattern to purge atmospheric gases from the enclosed area. Thereafter, the molten metal is transferred from the ladle 40 to the trumpet stand 44. No weight from the ladle 40 or ladle ring 48 is transferred to the trumpet stand 44. Only the blanket enclosure contacts both trumpet ring 68 and ladle ring 48, and the blanket enclosure cannot transfer weight due to its lack of mechanical rigidity.

Figure 2:
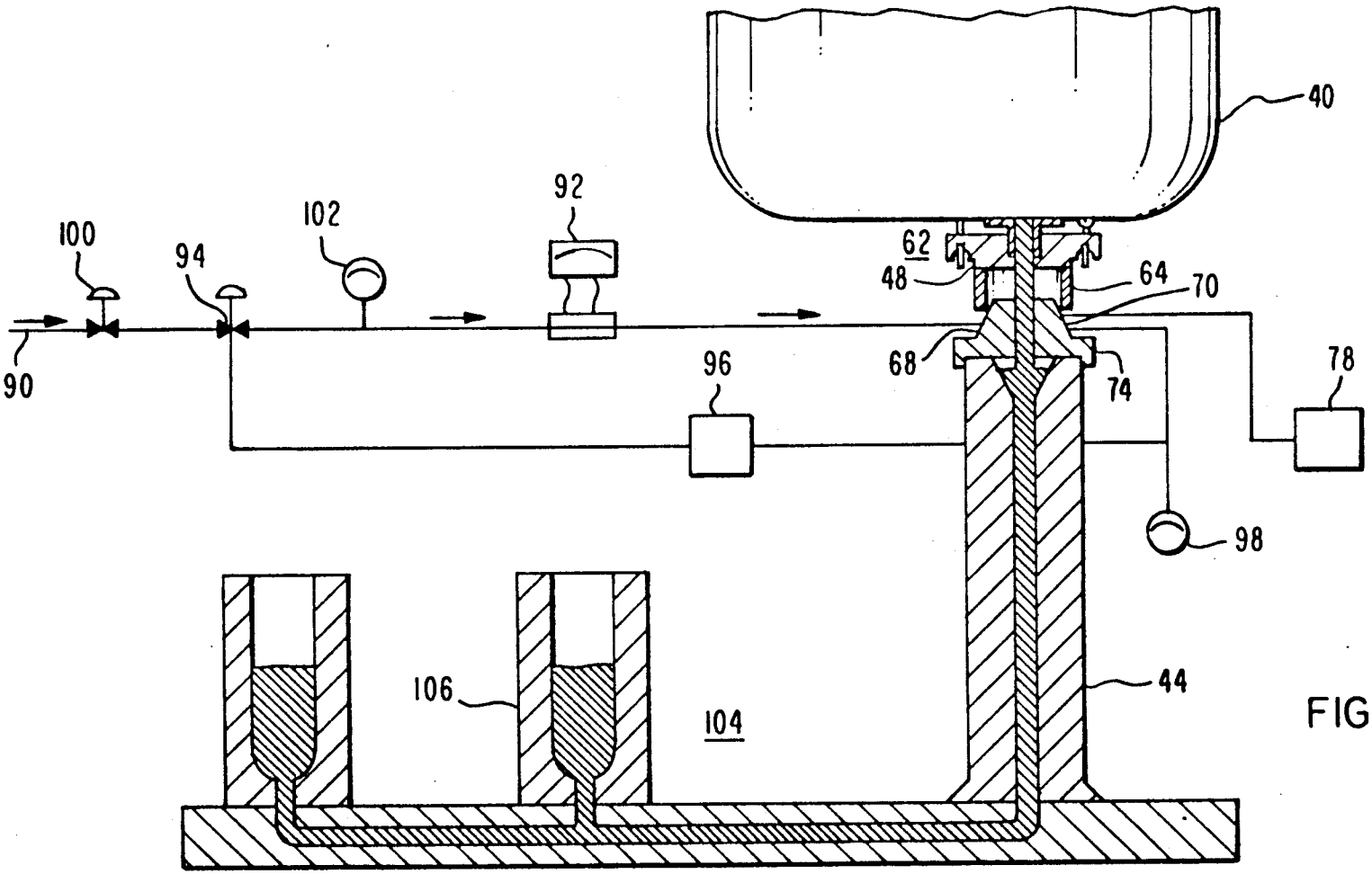
FIG. 2 is a schematic view of the preferred embodiment of the shrouding device during a teeming operation.

Referring to FIG. 2, in a preferred embodiment, the inert gas supply 90 includes a flow meter 92 for measuring the flow of the inert gas into the shrouding device 62. The inert gas supply 90 also includes a pressure reducer 100 and a pressure gauge 102. A flow control valve 94 for controlling the amount of inert gas that is provided to the shrouding device 62 is also included in the inert gas supply line. The flow control valve 94 is actuated by the pressure in the shrouding device 62 as measured by a pressure transducer flow control circuit. A pressure meter 98 is also included for visually observing the pressure in the shrouding device 62. Ideally the inert gas removed from the shrouding device 62 will be recycled through the flow control system 96 to the shrouding device 62. Thus, a minimal amount of inert gas is required for any particular teeming operation.

In a preferred embodiment, the flow of inert gas into the shrouding device 62 is controlled by a combination of the parameters of pressure, temperature, and oxygen or other contaminant gas content within the shrouding device 62. Control of the inert gas flow based on these parameters provides substantial benefits and avoids problem which can occur if these parameters for the shrouding device environment are not controlled. For example, control based on the oxygen or other contaminant gas content within the shrouding device minimizes the consumption of the inert gas while insuring that contaminant gas levels are maintained below acceptable levels. In addition, control based on the pressure within the shrouding device insures that the pressure within the shrouding device 62 is not so high that it forces slag or other low density contaminants through the mold system 104 and into the ingot molds 106. Moreover, control based on the temperature within the shrouding device insures that the area within the shrouding device is maintained at an acceptable temperature to avoid damage to the shrouding device.

To insure that no contaminant atmospheric gases are present within the trumpet ring 68 prior to the mating of the ladle ring 48 and the trumpet ring 68, the spaces within those rings are purged with an inert gas. Caps (not shown) are placed over the ladle ring 48 and the trumpet ring 68. The caps are then removed only immediately prior to the mating of the ladle ring 48 with the trumpet ring 68.

EXAMPLE 1

An experiment was conducted using the preferred shrouding device as shown in FIGS. 2-5 to shroud a teem stream which was bottom poured from a mastermelt of a high purity ferritic stainless steel having nominally 12-16% Cr and 1% Mo. The purpose was to determine if the structure of the invention reduces nitrogen pickup as compared to an unshrouded flow. Argon was injected into the shrouding device to reduce the atmospheric oxygen in the trumpet, runner and mold cavities. The trumpet ring included a ported gas ring on its inner circumference for injection of the argon. The viewing port was made from heat resistant pyrex. The oxygen sampling port of the trumpet ring was connected to a Teledyne Model 320P oxygen analyzer.

Initially, metal caps were placed over the ingot molds and trumpet stand after the trumpet ring was attached to reduce oxygen pickup. Argon flow was provided into the mold system from the capped trumpet ring at 3000 CFH and 75 psig for about 20 minutes. The oxygen analysis during this time remained at 2.6%.

The ladle was then aligned and mated to the trumpet ring and teeming commenced. The argon flow was maintained at 3000 CFH and 75 psig. The molten metal stream could be viewed through the viewing port without clouding.

Normal nitrogen pickup during this type of teeming operation is 35 to 40 ppm. However, by using the preferred shrouding device with argon as an inert gas, no substantial nitrogen pickup was detected during the teeming. Results of nitrogen analysis were as follows:

| | PPM Nitrogen | |
|---|---|---|
| Ladle | Sprue | Ingot |
| | Not shrouded | |
| 83 | — | 120 |
| 110 | 150 | — |
| 94 | 140 | — |
| | Shrouded | |
| 94 | 89 | 89, 91 |
| 110 | — | 120 |
| 150 | — | 160 |
| 138 | — | 140 |
| 90 | — | 89 |
| 122 | — | 120 |
| 82 | — | 100* |

(*Window of shroud cracked.)

The oxygen content within the shroud was analyzed at 0.5%. The oxygen reading remained at 0.5% until the teeming was about ⅔ complete, when the oxygen analysis increased rapidly to 15.0%. This reading is believed to be questionable due to the incompatibility of the Teledyne oxygen analyzer for use at elevated sampling temperatures (>130° F). Subsequent tests were made with a different oxygen analyzer which provided repeatable oxygen values.

EXAMPLE 2

A second experiment was conducted using the preferred shrouding device to shroud a team stream to protect it from atmospheric contamination. The experiment consisted of two parts. In the first part, molten metal was transferred without the benefit of the preferred shrouding device, and in the second part, the same molten metal was transferred with the benefit of the preferred shrouding device using argon as an inert gas within the shrouding device. The molten metal used was for an Fe-Cr-Al alloy with 19-21% Cr.

The results of this experiment were as follows:

| | PPM Nitrogen | |
|---|---|---|
| Sample Point | Unshrouded | Shrouded |
| Before stir | 72 | 68 |
| Before tap | 26 | 40 |
| Ladle final | 42 | 82 |
| After teem | 85 | 75 |
| Difference | Increase: 43 | Loss: 7 |

The analytical error for the nitrogen analysis of this alloy is ±4 PPM.

It should be appreciated that the detailed description and examples provided above are illustrative of the invention. Other modifications and changes could be made by one skilled in the art without departing from the invention. For example, the shrouding device of the invention can be adapted for use in top pour casting techniques and continuous casting techniques.

What we claim is:

1. A device for shrouding a flow of fluid during the transfer thereof from a movable ladle to a receiving vessel disposed generally beneath and spaced from the ladle comprising:

a nonrigid enclosure having generally vertically opposed apertures and defining therein a chamber through which the fluid flows, said enclosure being made of a flexible material for permitting vertical and acentric movement of said apertures relative to each other in response to vertical and horizontal deviations in the relative positions of the ladle and the receiving vessel;

a first means structured for suspension from the ladle for adjoining one said aperture in operatively fluid tight communication with the ladle such that the weight of said enclosure and said first adjoining means is supported in use by the ladle; and a second means mounted in use on the receiving vessel for adjoining the other said aperture in operatively fluid tight communication with the receiving vessel.

2. The device recited in claim 1 further comprising means for adjusting the spacing between said vertically opposed apertures.

3. The device recited in claim 1 further comprising means for flowing a desired gas through said enclosure.

4. The device recited in claim 1 further comprising a means for measuring the oxygen content inside said enclosure.

5. The device recited in claim 1 further comprising means for measuring the temperature within said enclosure.

6. The device recited in claim 1 further comprising means for measuring the pressure inside said enclosure.

7. The device recited in claim 3 wherein said gas is an inert gas.

8. The device recited in claim 1 wherein said enclosure is made of materials which are substantially impervious to gas.

9. The device recited in claim 1 wherein said means for adjoining said apertures to said pair of vessels comprises a first connection member surrounding one said aperture and being structured for engagement with one said vessel of said pair of vessels and a second connection member surrounding the other said aperture vertically spaced from said first connection member and being structured for releasable engagement with the other said vessel of said pair of vessels.

10. The device recited in claim 9 wherein said enclosure further comprises a flexible material and said first and second connection members are interconnected by said flexible material for permitting said enclosure to elongate in the vertical direction.

11. A device for shrouding a flow of fluid during the transfer thereof between a pair of vertically spaced vessels comprising:

a nonrigid enclosure having generally vertically opposed apertures for providing fluid communication between the pair of vessels;

first and second means structured for adjoining each of said apertures in operatively fluid tight communication with said pair of vessels; and at least two first elongate rods each being connected at one end thereof to said first adjoining means and having a stop at the opposing free end and at least two second elongate rods each connected at one end thereof to said second adjoining means and having at the opposing free end a receiving member for slidably engaging a corresponding first elongate member such that the distance between said first and second adjoining means is adjusted by sliding said first elongate rods through said receiving members of said corresponding second elongate rods.

12. The device recited in claim 9 wherein said first connection member is in releasable engagement with one said vessel of said pair of vessels.

13. The device recited in claim 9 wherein said first connection member is in substantially fixed engagement with one said vessel of said pair of vessels.

14. The device recited in claim 9 further comprising means for flowing a desired gas through said enclosure comprising at least one inlet port and at least one outlet port disposed in at least one of said first and second connecting members and means for fluidly connecting said at least one inlet port to a source of a desired gas.

15. The device recited in claim 14 further comprising means for operatively fluidly connecting said at least one outlet port to said source for returning said gas to said source for reuse.

16. The device recited in claim 9 wherein said pair of vertically spaced vessels comprise an upper vessel and a lower vessel;

said first connection member is suspended from said upper vessel; and said second connection member is mounted on said lower vessel and comprises a rigid lower portion and a rigid upper portion structured for mating engagement with said enclosure in a substantially fluid tight relationship.

17. The device recited in claim 16 wherein said rigid upper portion of said second connection member is frusto-conical in shape and said enclosure is made of a ceramic fiber, double ply material in the form of a cylinder adapted to receive said rigid upper portion therein.

18. The device recited in claim 16 wherein said upper support member of said first connection member is hingedly attached to said upper vessel and includes means for releasable locking engagement with said upper vessel.

19. The device recited in claim 1 further comprising a transparent portion within said enclosure to permit observation of the interior thereof.

20. The device recited in claim 1 wherein said second adjoining means has a rigid upper portion, frusto-conical in shape and said enclosure is in the form of a flexible cylinder structured to receive said upper portion therein and to maintain fluid tight communication with the receiving vessel through said vertical and horizontal movement of the ladle relative to the receiving vessel.

21. A device for shrouding the transfer of molten metal from a first vessel to a second vessel, the device comprising:

a first ring for quick detachable connection in use to a metal transfer port in said first vessel;

a flexible, heat resistant enclosure having first and second ends and being attached to said first ring at said first end; and a second ring having a first conical section adapted in use to be releasably fit into said second end of said enclosure and a second section structured for a releasable fit over a metal receiving port in said second vessel.

22. The device of claim 21 wherein said second section of said second ring comprises one or more locking thumbscrews for releasably securing said second ring to said second vessel.

23. The device of claim 21 further comprising a viewing window in said second ring.

24. The device of claim 21 further comprising a gas sampling port in said second ring.

25. The device of claim 21 further comprising one or more gas ports in said second ring, said gas ports communicating between an external circumference of said second ring and an inner circumference of said second ring.

26. A method for shrouding a stream of molten metal being transferred from a first vessel to a second vessel, the method comprising the steps of:

attaching one end of a flexible, open-ended enclosure to an exit port of said first vessel such that said enclosure is centered relative to said exit port of said vessel;

attaching one end of an open-ended enclosure to a metal receiving port in said second vessel such that said second enclosure is centered relative to said metal receiving port;

mating said open ends of said first and second enclosures;

introducing a flow of a desired gas through at least one of said first or second enclosures to eliminate atmospheric contaminants in said enclosure and pressurize said enclosures to a level greater than or equal to atmospheric pressure; and transferring molten metal from said first vessel to said second vessel through said first and second enclosures.

27. The method of claim 26 wherein said desired gas is withdrawn from and recycled back to said first enclosure.

28. The method of claim 26 wherein the oxygen concentration within said first and second enclosures is monitored during the transfer of the molten metal.

29. The method of claim 26 further comprising regulating the rate of said flow of a desired gas according to parameters reflecting the conditions within said first and second enclosures selected from the group consisting of pressure, temperature, oxygen content and a combination thereof.

* * * * *

UNITED STATES PATENT AND TRADEMARK OFFICE

CERTIFICATE OF CORRECTION

PATENT NO. : 5,131,573

DATED : July 21, 1992

INVENTOR(S) : J. W. Tommaney et al

It is certified that error appears in the above-indentified patent and that said Letters Patent is hereby corrected as shown below:

In column 10, (cliam 9) line 1, delete "1" and substitute --11--; and before "means", insert --first and second--.

Signed and Sealed this

Twenty-eighth Day of September, 1993

Bruce Lehman

*Attest:*

BRUCE LEHMAN

*Attesting Officer*

*Commissioner of Patents and Trademarks*